US011376616B2

(12) United States Patent
Anderson et al.

(10) Patent No.: US 11,376,616 B2
(45) Date of Patent: Jul. 5, 2022

(54) RECYCLABLE PUMP ASSEMBLY WITH PIVOTING DIP TUBE

(71) Applicant: Tessy Plastics Corporation, Elbridge, NY (US)

(72) Inventors: Brian Anderson, Baldwinsville, NY (US); Robert Benson, East Syracuse, NY (US); Ben Passetti, Weedsport, NY (US)

(73) Assignee: Tessy Plastics Corporation, Elbridge, NY (US)

( * ) Notice: Subject to any disclaimer, the term of this patent is extended or adjusted under 35 U.S.C. 154(b) by 0 days.

(21) Appl. No.: 17/167,377

(22) Filed: Feb. 4, 2021

(65) Prior Publication Data

US 2021/0237109 A1 Aug. 5, 2021

Related U.S. Application Data

(60) Provisional application No. 62/979,155, filed on Feb. 20, 2020, provisional application No. 62/969,878, filed on Feb. 4, 2020.

(51) Int. Cl.
*B05B 11/00* (2006.01)
*B05B 15/30* (2018.01)

(52) U.S. Cl.
CPC ..... *B05B 11/0091* (2013.01); *B05B 11/3047* (2013.01); *B05B 15/30* (2018.02)

(58) Field of Classification Search
CPC . B05B 11/0091; B05B 11/3047; B05B 15/30; B05B 11/3077; B05B 11/3067; B05B 11/3011
USPC ..... 222/189.1, 219, 401, 464.3
See application file for complete search history.

(56) References Cited

U.S. PATENT DOCUMENTS 2,920,798 A * 1/1960 Samuel ..... B65D 83/32 222/402.19
5,307,962 A * 5/1994 Lin ..... B05B 11/0064 222/321.9
5,381,961 A * 1/1995 Evans ..... B05B 11/0059 239/333
5,522,548 A * 6/1996 Gallien ..... B65D 83/32 222/402.1
6,742,677 B2 * 6/2004 Petit ..... B05B 11/0059 222/321.7
7,637,397 B2 * 12/2009 Conway ..... B05B 11/0059 222/382
8,281,960 B1 * 10/2012 Gers ..... B05B 11/3011 222/377

(Continued)

*Primary Examiner* — Vishal Pancholi
(74) *Attorney, Agent, or Firm* — Barclay Damon LLP

(57) ABSTRACT

A pump assembly for a pump dispenser, the pump assembly comprises a cap having a housing and a spout, a collar, a sleeve, and a dip tube. The sleeve is at least partially positioned within the collar and comprises a coupling member. The coupling member comprises a shoulder, a coupling joint, and a coupling member channel extending from the shoulder to the coupling joint. The dip tube has a first end and an opposing second end, and defines a dip tube channel extending from the first end to the second end. The first end of the dip tube is configured to pivotally couple to the coupling joint and fluidly connect the dip tube channel and the coupling member channel. The dip tube channel comprises a first diameter at the first end and second diameter at the second end that is different than the first diameter.

20 Claims, 10 Drawing Sheets

(56) References Cited

U.S. PATENT DOCUMENTS

2008/0121664 A1* 5/2008 Ophardt ..... B05B 11/3001
222/321.9

* cited by examiner

200

RECYCLABLE PUMP ASSEMBLY WITH PIVOTING DIP TUBE

CROSS-REFERENCE TO RELATED APPLICATIONS

This application is a non-provisional patent application of, and claims the priority and benefit of, U.S. Provisional Patent Application Ser. No. 62/969,878, filed on Feb. 4, 2020, and U.S. Provisional Patent Application Ser. No. 62/979,155, filed Feb. 20, 2020. This non-provisional patent application is also related to patent application Ser. No. 16/243,483, filed on Jan. 9, 2019, now U.S. Pat. No. 10,751,740, entitled "ECO PUMP." The entire contents of said applications are hereby incorporated by reference.

TECHNICAL FIELD

This application is generally directed to the field of pump assemblies for dispensing containers and more specifically to a pump assembly comprising an pivoting dip tube. The entire assembly including the components of the pivoting dip tube are comprised completely of components made of the same type of recyclable material such that it is easy and also cost-effective to recycle.

BACKGROUND

Pump dispensers generally comprise a pump assembly coupled to a dispensing container and are a common form of packaging for products such as toothpaste, liquid soap, lotion, cleaning supplies, and many other useful products. Such pump dispensers enable the user to carefully control the dispensing of the product from the dispensing container into their hands or onto another surface. However, the pump assemblies currently used in the pump dispensers suffer from inefficiencies which result in wasted product. This is because many of the dispensing containers used have a bottom surface that has on or more raised and subsequently depressed areas. For example, many dispensing containers have a bottom surface that is curved such that it protrudes into the interior of the dispensing container. The curved bottom surface increases the stability and the strength of the dispensing container. The curved nature of the bottom surface creates one or more depressed areas or valley on the bottom surface where the contents or product contained in the dispensing container collects. Due to the position of the dip tube in the current pump assemblies, this product cannot be removed from the depressed areas and it is therefore wasted. Repositioning the dip tube in current pump assemblies requires a reconfiguration of one or more components of the entire assembly. Accordingly, dispensing containers of varying designs and configurations comprising differently curved bases require custom pump assemblies manufactured specifically for each different type of dispensing container. Such custom manufacturing increases manufacturing turnaround time or retooling time when switching between products as well as the overall cost.

Current pump assemblies further pose a challenge when used in high-speed assembly systems. Movement of the pump assemblies through these systems causes the free ends of the dip tubes to move such that the dip tubes can become snagged, caught, or bent due to interaction with system components and during installation onto the dispensing container. The damaged dip tubes must then be replaced, which requires a stoppage of the system and a decrease in overall production due to system stoppage. To help mitigate damage to the dip tube, Some systems include a restraining device or mechanism that restricts movement of the dip tube prior to and during installation onto the dispensing container. These extra system components add to the overall cost of the manufacturing process and therefore, the overall cost of the final product.

In addition, many of the pump assemblies currently manufactured are used in conjunction with dispenser containers that are recyclable however, one or more of the components that comprise the pump assemblies are manufactured from non-recyclable materials for the sake of durability and cost efficiency. This includes using one or more metal springs or compression members and valves comprised of glass, metal, non-recyclable resins such as Polyoxymethylene (POM). Consequently, in order to recycle these pump assemblies, additional processing is required to separate out any non-recyclable components or components not made of the same type of recyclable material. This additional separation step takes extra time and costs money for the recycling companies, manufacturers, and/or users. In many instances, consumers or recycling companies simply throw away the pump assemblies rather than spend time dismantling the pump assembly for proper recycling. However, producing pump assemblies entirely from recyclable components produces pumping or dispensing inefficiencies due to the low spring force produced from plastic springs and the relatively low density of pump assembly components as compared with the material that is being pumped by or dispensed by the pump assembly.

The foregoing background describes some, but not necessarily all, of the problems, disadvantages and shortcomings related to current pump assemblies used in pump dispensers.

SUMMARY

An embodiment of a pump assembly for a pump dispenser comprises a cap comprising a depression surface and a spout extending from the depression surface. A collar is configured to at least partially surround the cap and the depression surface is configured to move relative to the collar. A sleeve is coupled to the collar and comprises a body extending along a body axis and defining an inner space, and a coupling member. The coupling member comprises a shoulder and a coupling joint proximate the shoulder. A dip tube defines a dip tube channel extending from a first end to an opposing second end of the dip tube. The first end of the dip tube is configured to pivotally couple to the coupling joint and fluidly connect the dip tube channel, the coupling member channel, the inner space of the sleeve, and the spout. The fluid connection is maintained when the dip tube is pivoted relative to the coupling joint.

In an embodiment, the dip tube channel comprises a first diameter at the first end and second diameter at the second end that is different than the first diameter. In an embodiment. The pump assembly further comprises a valve positioned in a valve chamber defined within the coupling member. In another embodiment, the pump assembly comprises a valve positioned in a valve chamber defined within the dip tube. In a further embodiment, the first end of the dip tube comprises a greater thickness than the second end. In an embodiment, the first end of the dip tube is configured to at least partially fit over the coupling member. In another embodiment, the first end of the dip tube is configured to be at least partially positioned within the coupling member. In still another embodiment, the coupling member further comprises a coupling member channel extending from the shoulder to the coupling joint. In another embodiment, the shoulder is configured to inhibit damage to the first end of the dip tube resulting from over-insertion of the first end onto the coupling joint.

Another embodiment of a pump assembly for a pump dispenser comprises a cap comprising a spout and a sleeve in fluid communication with the cap. The sleeve comprises a body extending along a body axis and defining an inner space, and a coupling member. The coupling member defines a coupling member channel. A dip tube defining a dip tube channel extends from a first end to an opposing second end. The first end of the dip tube is configured to pivotally couple to the coupling member and fluidly connect the dip tube channel, the coupling member channel, the inner space of the sleeve, and the spout. The fluid connection is maintained when the dip tube is pivoted relative to the coupling member.

Another embodiment of a pump assembly for a pump dispenser comprises a spout and a sleeve in fluid communication with the spout. The sleeve comprises a body extending along a body axis and defining an inner space, and a coupling member defining a coupling member channel. A dip tube defines a dip tube channel extending from a first end to an opposing second end. The first end of the dip tube is configured to pivotally couple to the coupling member and fluidly connect the dip tube channel, the coupling member channel, the inner space of the sleeve, and the spout. The fluid connection is maintained when the dip tube is pivoted relative to the coupling member.

BRIEF DESCRIPTION OF THE DRAWINGS

So that the manner in which the features of the invention can be understood, a detailed description of the invention may be had by reference to certain embodiments, some of which are illustrated in the accompanying drawings. It is to be noted, however, that the drawings illustrate only certain embodiments of this invention and are therefore not to be considered limiting of its scope, for the scope of the invention encompasses other equally effective embodiments. The drawings are not necessarily to scale, emphasis generally being placed upon illustrating the features of certain embodiments of the invention. In the drawings, like numerals are used to indicate like parts throughout the various views. Thus, for further understanding of the invention, reference can be made to the following detailed description, read in connection with the drawings in which.

DETAILED DESCRIPTION

The following discussion relates to various embodiments of a recyclable pump assembly with an pivoting dip tube for use with a dispensing container. It will be understood that the herein described versions are examples that embody certain inventive concepts as detailed herein. To that end, other variations and modifications will be readily apparent to those of sufficient skill. In addition, certain terms are used throughout this discussion in order to provide a suitable frame of reference with regard to the accompanying drawings. These terms such as "upper", "lower", "forward", "rearward", "interior", "exterior", "front", "back", "top", "bottom", "inner", "outer", "first", "second", and the like are not intended to limit these concepts, except where so specifically indicated. The terms "about" or "approximately" as used herein may refer to a range of 80%-125% of the claimed or disclosed value. With regard to the drawings, their purpose is to depict salient features of the pump assembly with pivoting dip tube and are not specifically provided to scale.

Figure 1:
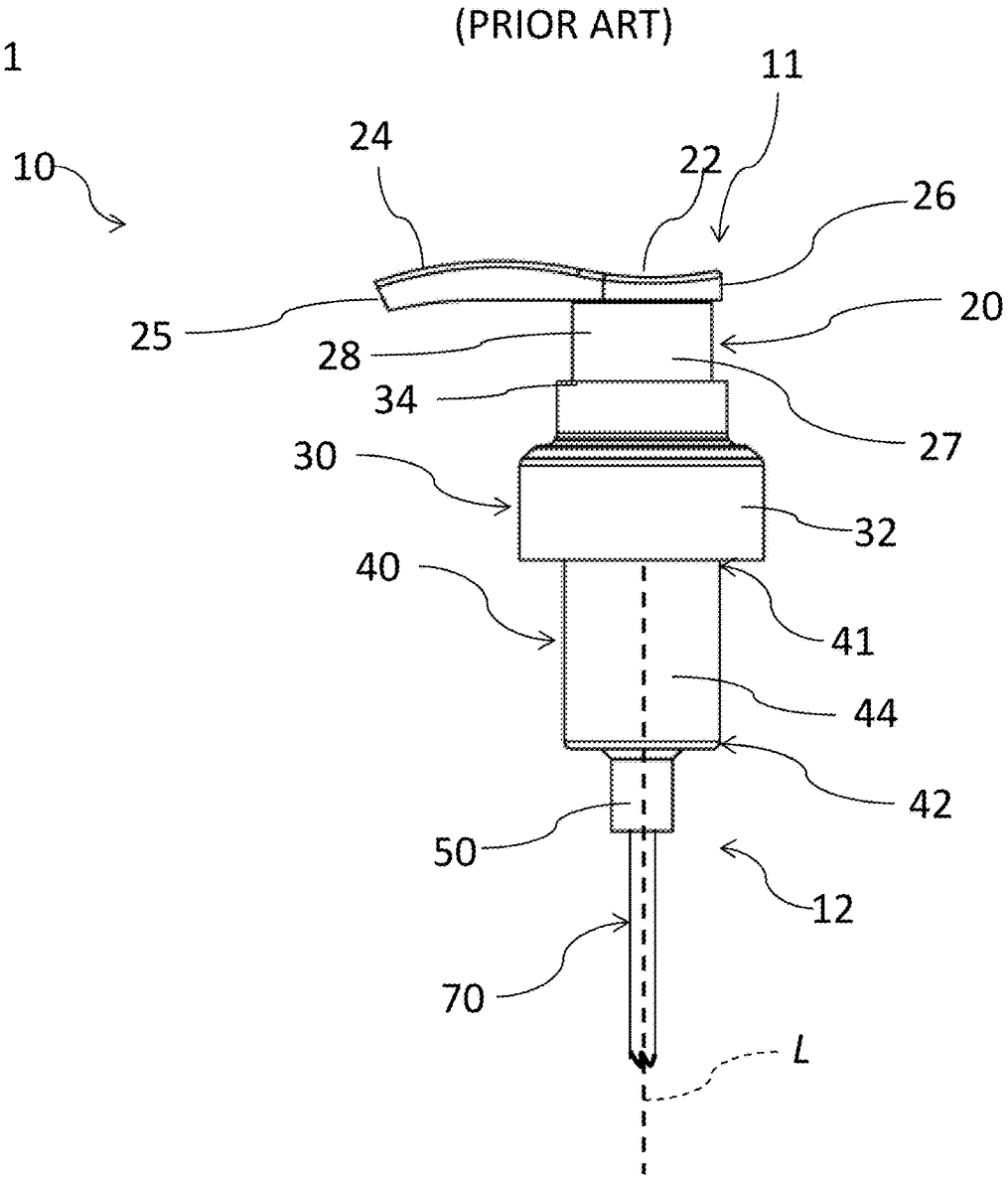
FIG. 1 illustrates a side elevation view of an embodiment of a pump assembly with a prior art dip tube.

Referring to FIG. 1 a pump assembly 10 for a dispenser container 100 (FIG. 2) has a top end 11 and a bottom end 12, and generally includes a cap 20, a sleeve 40, and a dip tube 70 coupled to the sleeve 40.

The cap 20 is generally positioned at a top end 11 of the pump assembly 10 and may comprise a collar 30 that at least partially houses a portion of and/or is coupled to the sleeve 40. The cap 20 includes an engagement sleeve 28 with a depression surface 22. A spout 24 extends from the depression surface 22 and defines an opening 25. As shown, the engagement sleeve 28 may be substantially cylindrical in shape and may define an interior cavity (not shown) configured to house additional components of the pump assembly 10 as are detailed in related U.S. Pat. No. 10,751,740. A lip 26 or other similar feature may protrude in a radial direction from the engagement sleeve 28 and/or the depression surface 22. In an embodiment, the cap 20 may have one or more engagement features located on a surface 27 of the engagement sleeve 28 that are configured to removably engage with the collar 30 and/or the sleeve 40. As shown, the cap 20 is capable of moving relative to the collar 30.

Still referring to FIG. 1, the collar 30 has an exterior surface 32 that surrounds at least a portion of the sleeve 40. The exterior surface 32 may comprise one or more different diameters such that the exterior surface 32 may appear to step inward or curve inward as the exterior surface 32 extends towards the depression surface 22. In an embodiment, the exterior surface 32 of the collar 30 may be substantially smooth, however in other embodiments, the exterior surface 32 of the collar 30 may comprise a plurality of surface features, such as ridges and/or grooves, or the like. The collar 30 may further comprise a stop member or stop surface 34 configured to contact the lip 26 when the cap 20 is depressed. In an embodiment, the lip 26 and a portion of the spout 24 both contact the stop member 34 when the cap 20 is depressed in a direction towards the bottom end 12 in order to prevent over compression and breakage of the pump assembly 10.

Figure 2:
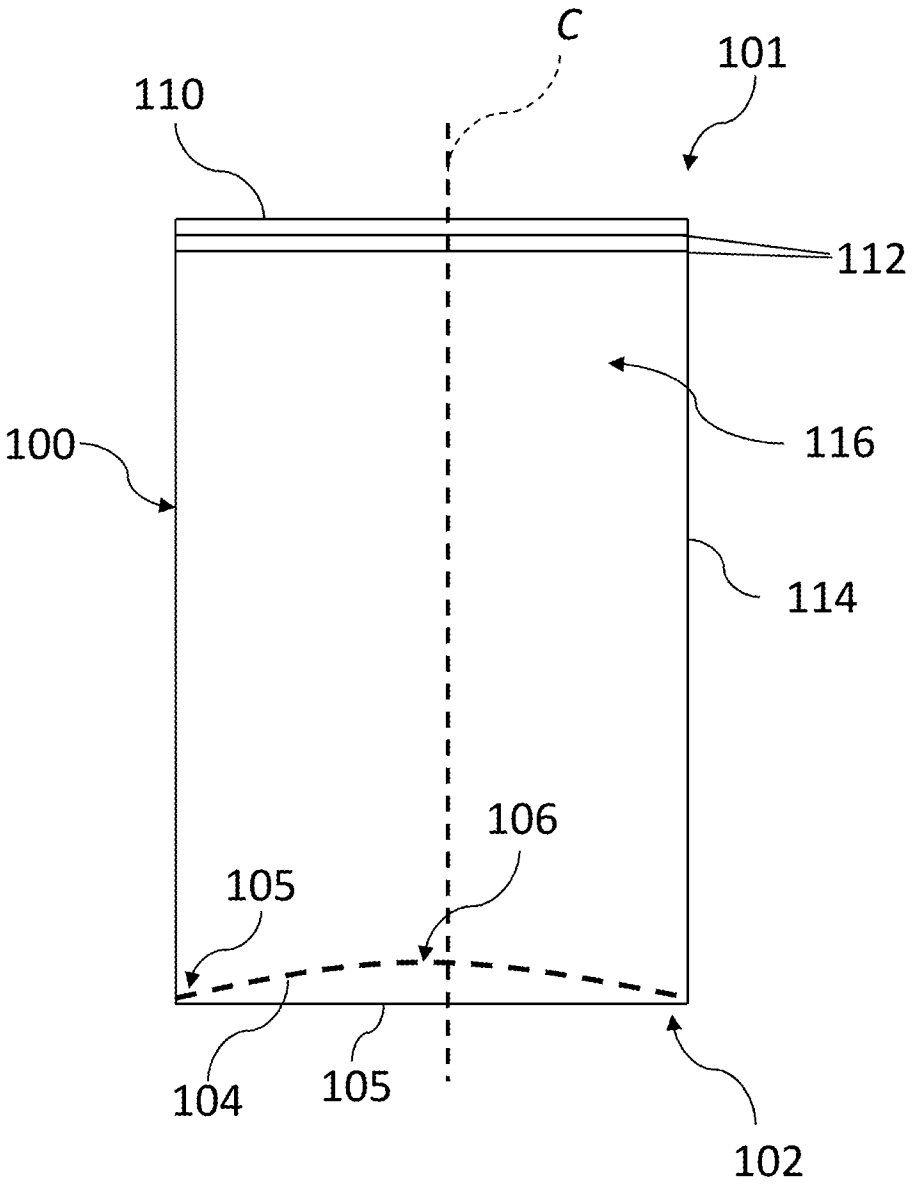
FIG. 2 illustrates a schematic cross-sectional view of an embodiment of a dispensing container.

The collar 30 further comprises an interior surface (not shown) that may include one or more surface features configured to engage one or more complimentary surface features 112 (FIG. 2) position on or defined on a surface of the dispenser container 100 (FIG. 2). The one or more surface features may be formed as a single unit with the collar 30. In a further embodiment, the one or more surface features may comprise a plurality of threads. In another embodiment, the one or more surface features may enable a snap-lit engagement with the dispenser container 100 (FIG. 2).

The sleeve 40 generally comprises a top end 41 configured to engage a portion of the cap 20 and/or a portion of the collar 30, and a bottom end 42 that may removably couple to an end of a dip tube 70. In an embodiment, the collar 30 and the sleeve 40 may be two separate components, however in other embodiments, the collar 30 and the sleeve 40 are formed as one piece and are a single unitary component.

Figure 4A:
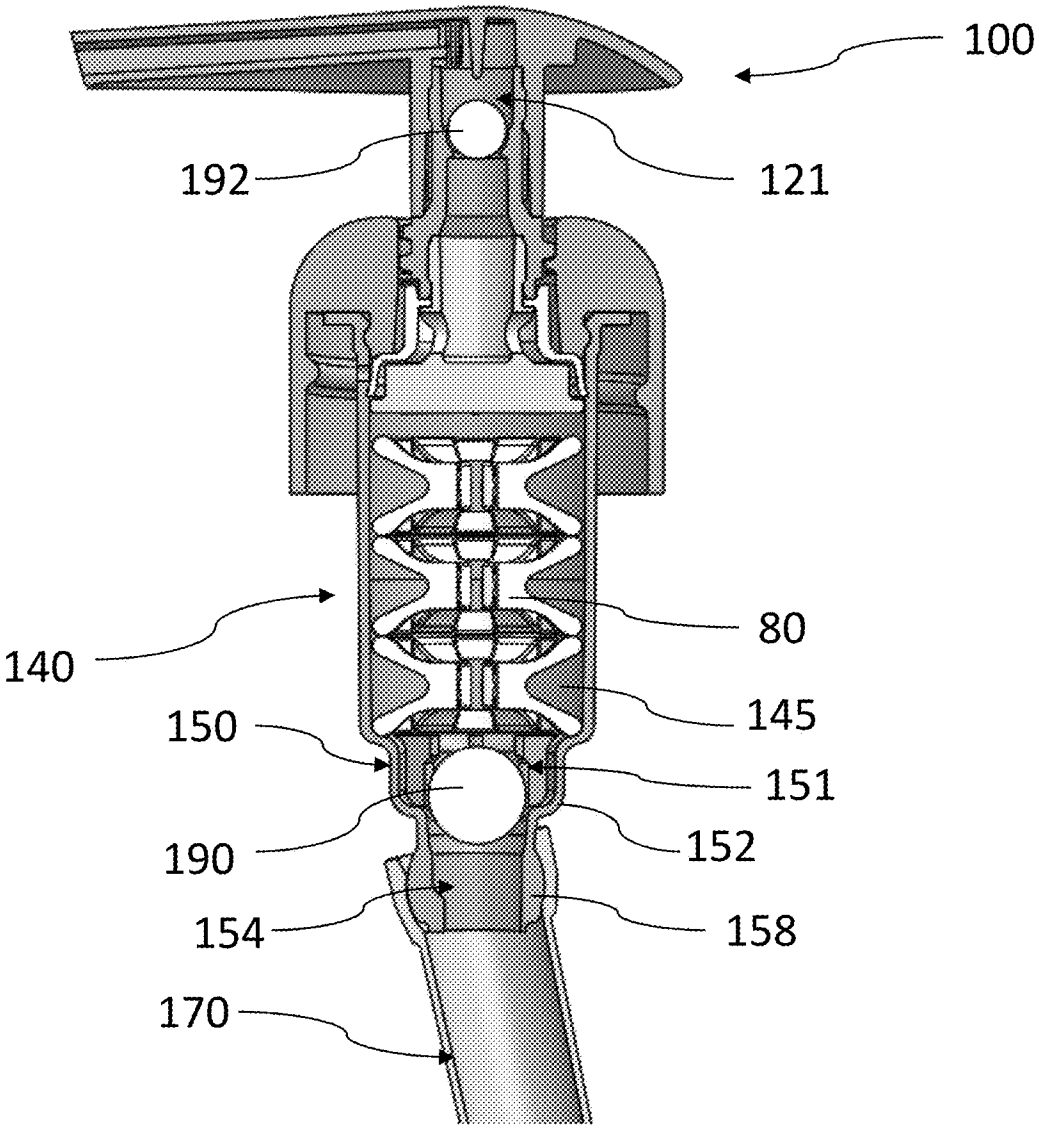
FIG. 4A illustrates a cross-sectional view of another embodiment of a pump assembly with an pivoting dip tube.

As shown in FIG. 1, the sleeve 40 extends along a sleeve axis L and may have a tubular shape. The outer surface 44 of the sleeve 40 is substantially smooth, however in other embodiments, the outer surface 44 may not be substantially smooth and instead may have one or more surface features, such as grooves or ridges that may interact with other components of the pump assembly 10 and/or the dispensing container 100 (FIG. 2). The sleeve 40 may surround one or more additional components of the pump assembly 10, such as one or more resilient members 80 (FIG. 4A). The sleeve 40 may include a coupling portion 50 that couples the dip tube 70 to the sleeve 40.

An embodiment of a dispenser container 100 is schematically shown in FIG. 2. The dispenser container 100 extends along a dispensing container axis C and has a top 101 end configured to couple to the pump assembly 10, and a bottom 102. The dispenser container 100 has in inner space 116 defined by a bottom surface 104 shown in phantom, and a plurality of sides 114. The plurality of sides 114 may be joined or coupled to the bottom surface 104 at a perimeter surface 105 or perimeter edge. As shown, the dispenser container 100 is tubular or cylindrical in shape, however in other embodiments the dispenser container 100 may have n number of sides and a polygonal cross-section. An opening 110 is defined at the top 101 and one or more complimentary surface features 112 may be formed towards the top 102 and proximate the opening 110. The one or more complimentary surface features 112 are configured to engage engagement features on the pump assembly 10 to enable coupling if the pump assembly 10 to the dispenser container 100.

Figure 7:
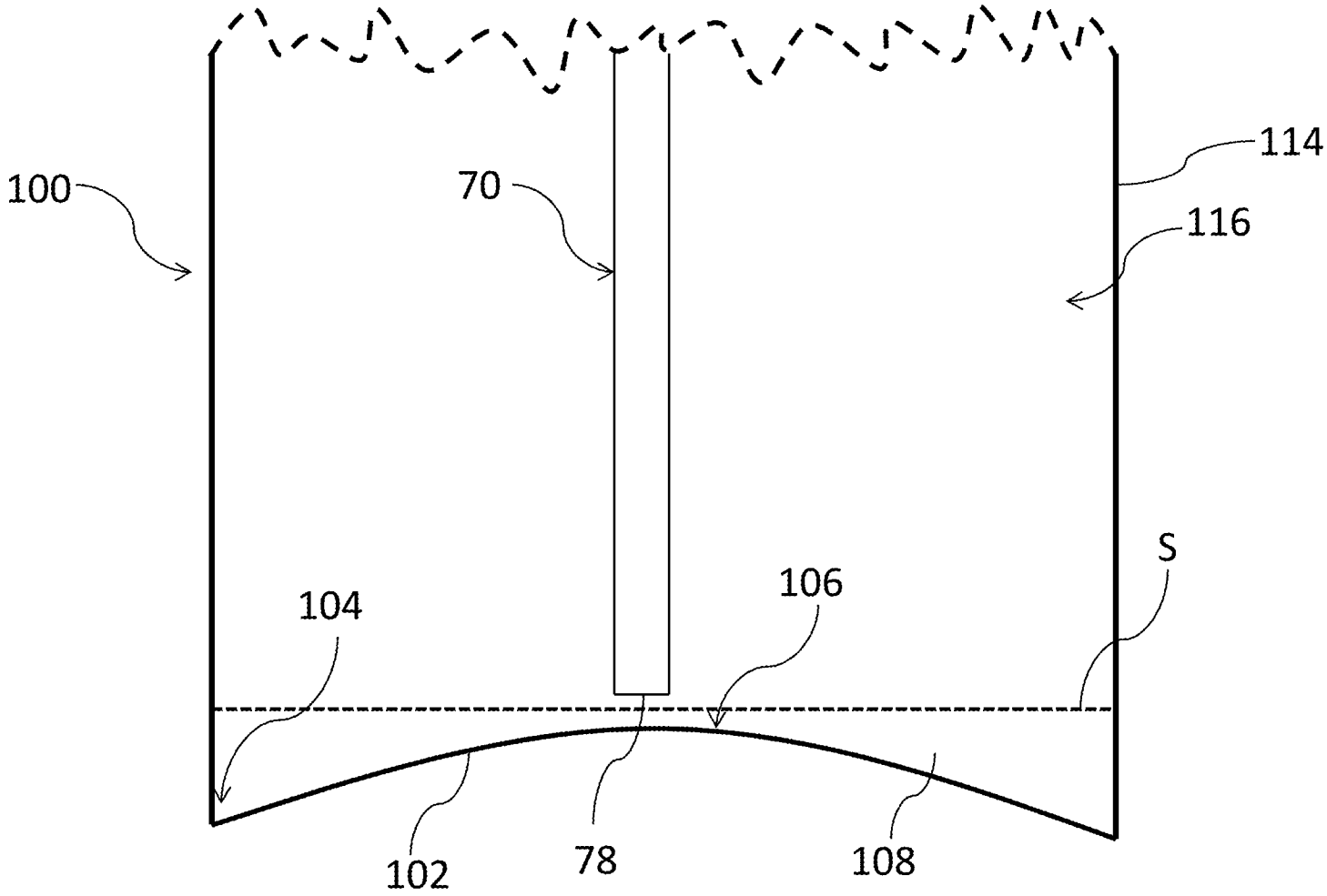
FIG. 7 illustrates a schematic depiction of the pump assembly of FIG. 1 showing the position of the prior art dip tube when the pump assembly is installed onto a dispensing container.

The bottom surface 104 may generally be curved in shape with an apex 106 that protrudes into the inner space 116 of the dispenser container 100. The perimeter surface 105 may define or be comprised of a depression, or reservoir extending around the perimeter of the bottom surface 104. In other embodiments, the bottom surface 104 may comprise a different configuration of raised and depressed areas as required by the nature of the dispenser container 10). The curved nature of the bottom surface 104 increases the strength of the dispenser container 100, but creates wasted product as pump assemblies currently in use with a fixed dip tube 70 as shown in FIGS. 1 and 7, have trouble extracting the entire contents 108 of the dispensing container.

Figure 3:
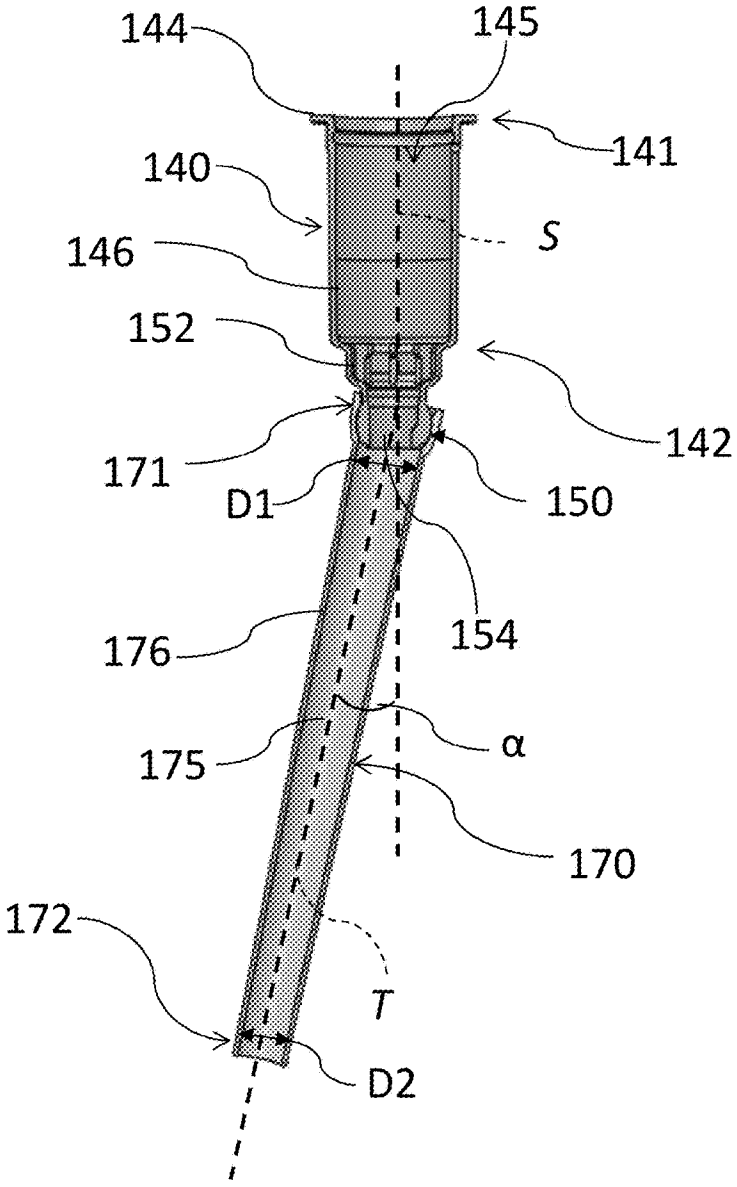
FIG. 3 illustrates a cross-sectional view of an embodiment of an pivoting dip tube pivotally coupled to an embodiment of a sleeve of a pump assembly.
Figure 4B:
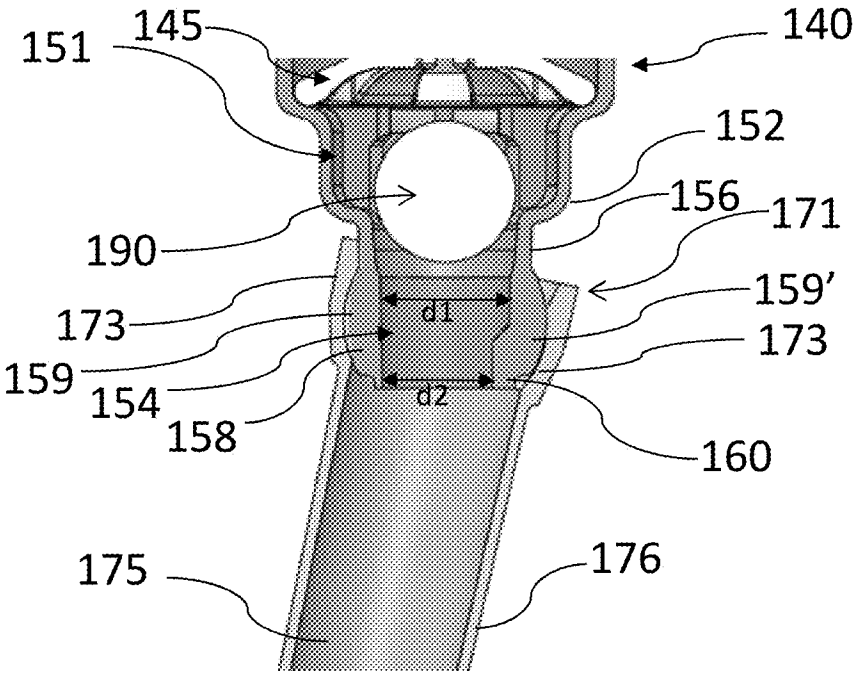
FIG. 4B illustrates a close-up cross-sectional view of an embodiment of an pivoting dip tube and coupling member of a pump assembly.

Referring to FIGS. 3-4B, a cross-section of a sleeve 140 with a coupling portion 150 or coupling member is shown. The sleeve 140 incudes a body 146 having a top 141 and extending along a sleeve axis S to a bottom 142. A coupling edge 144 is formed at the top 141 of the body 146 and is configured to couple to additional components of the pump assembly 10 such as the collar 30 and/or the cap 20. The body 146 of the sleeve 140 defines a sleeve chamber 145 configured to house additional components of the pump assembly 10, such as one or more compression members or resilient members 80 (FIGS. 4A-4B). A coupling portion 150 is formed at the bottom 142 of the body 146 and is configured to moveably and fluidly couple the dip tube 170 to the body 146 of the sleeve 140. The coupling portion 150 includes a coupling joint 158 that may generally comprise a ball, spherical, or hemispherical shape. The coupling joint 158 defines a coupling portion channel 154 extending from the sleeve chamber 145. A stop shoulder 152 may be positioned between the bottom 142 of the sleeve 140 and the coupling joint 158 and inhibits damage to the dip tube 170 resulting from over insertion or over articulation of the dip tube 170 onto the coupling joint 158.

The dip tube 170 comprises a body 176 defining a dip tube channel 175 that extends along a dip tube axis T (FIG. 3) from a first end 171 and a second end 172. The dip tube channel 175 has a first diameter D1 at the first end 171 and a second diameter D2 at the second end 172. As shown, the first diameter D1 is greater than the second diameter D2 to enable the first end 171 to snap onto or slide onto the coupling joint 158 of the coupling portion 150. The first end 171 of the dip tube 170 may stretch or deform elastically or plastically in order to at least partially surround the coupling portion 150 and provide a friction fit that may be liquid and/or air-tight. In an embodiment, the thickness of the dip tube wall 173 may be greater at the first end 171 than at the second end 172. Inserting the dip tube 170 over the coupling joint 158 fluidly connects the coupling portion channel 154 with the dip tube channel 175 and further enables the dip tube 170 to be rotated, swiveled, or otherwise pivoted relative to the sleeve 140 and about the coupling joint 158. The coupling portion channel 154 and the dip tube channel 175 remain fluidly connected during articulation of the dip tube 170. The dip tube 170 may be pivoted relative to the sleeve 140 about the coupling joint 158 such that the angle $\alpha$ between the sleeve axis L and the dip tube axis T may be from 0° to about 30°.

A cross-section of an embodiment of the sleeve 140 is shown in FIGS. 4A-4B coupled to a cap 20. The sleeve 140 includes a valve 190 positioned in a valve chamber 151 between the sleeve chamber 145 and the coupling portion channel 154. As can be seen in FIGS. 4A-4B, a second valve 192 is positioned within the cap 20. In an embodiment, the stop shoulder 152 may surround or otherwise define the valve chamber 151. The valve 190 may be a ball valve or otherwise comprise a spherical shape with a maximum diameter that is greater than the diameter of the coupling portion channel 154 proximate the valve chamber 151. The ball valve 192 may be housed in a valve chamber 121 that is similar to the valve chamber 151 of the coupling portion 150. The ball valves 190, 192 are comprised of a material with a specific gravity that is greater than 1, such as polyethylene terephthalate (PET) that has a specific gravity of about 1.3. The high specific gravity ensures that the ball valves 190, 192 do not float on the surface of the material being pumped through and dispensed by the pump assembly 10. The high specific gravity allows the valves 190, 192 to quickly sink in order to seal off the valve chambers 21, 151 between pump strokes.

Since the resilient members 80 of the embodiments of the pump assemblies shown are comprised of a recyclable material, they exhibit a lower spring force than a metal spring. The low spring force makes the pump assembly less able to overcome pumping inefficiencies. Forming the ball valves 190, 192 from a recyclable material, such as PET, that has a specific gravity greater than 1 optimized material dispensing and increases the efficiency of each pump stroke of the pump assembly 10 as well as the dispensing accuracy. This is done by minimizing air and/or material from passing through open or improperly sealed valve chambers.

Figure 5A:
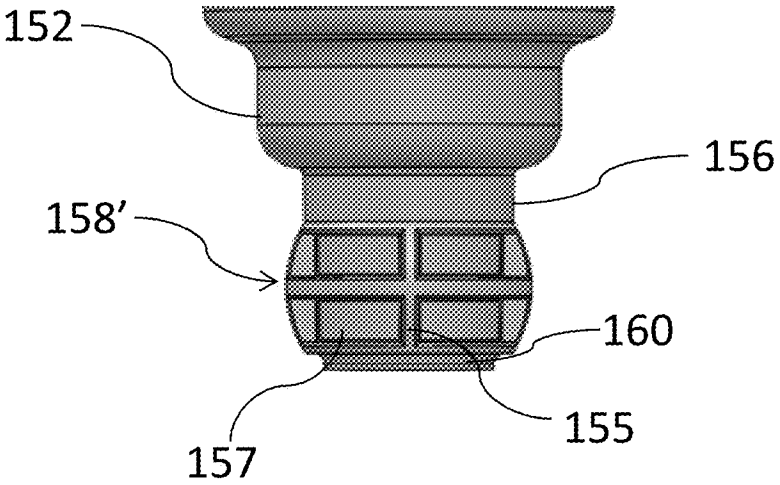
FIG. 5A illustrates a side elevation view of an embodiment of a coupling portion of the pump assembly.
Figure 5B:
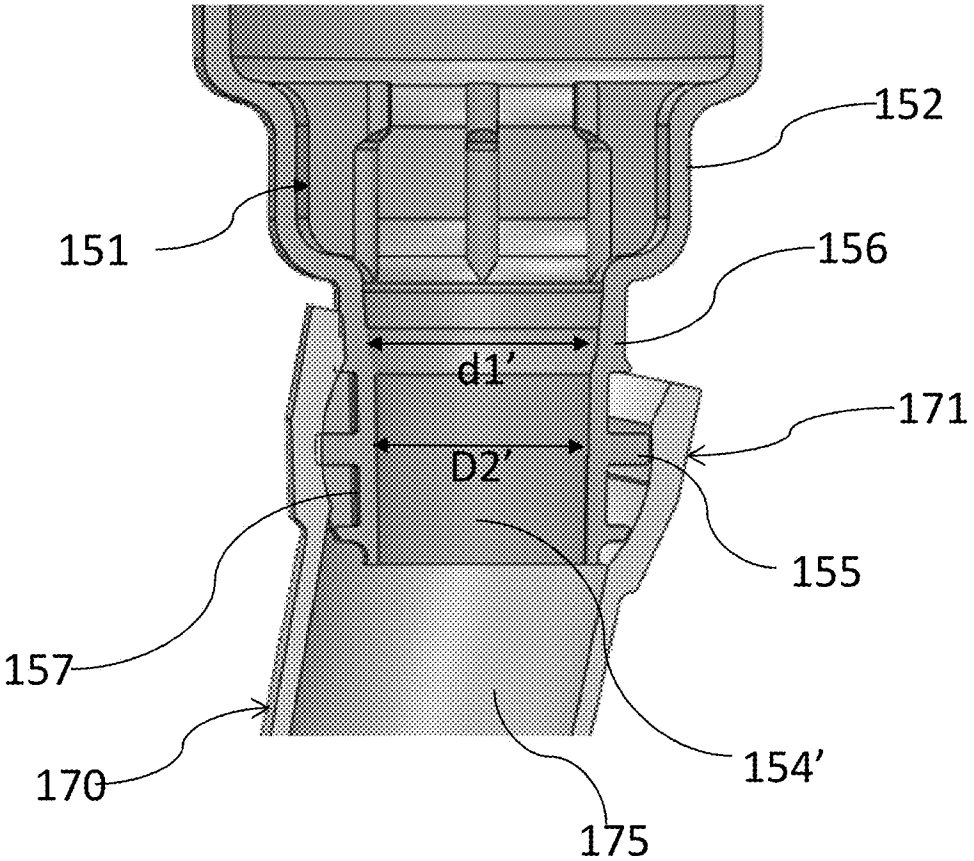
FIG. 5B illustrates cross-sectional view of the embodiment of the coupling portion of FIG. 5A coupled to an embodiment of the dip tube.

Still referring to FIGS. 4A and 4B, the coupling joint 158 may be held away from the stop shoulder 152 by a neck portion 156. The coupling joint 158 may comprise sides 159, 159' that are of varying thickness and the coupling portion channel 154 may comprise a first diameter d1 proximate the valve chamber 151 and a second diameter d2 proximate the dip tube channel 175. In the embodiment shown, the first diameter d1 is greater than the second diameter d2, however in other embodiments, the first diameter d1 may be less than or equal to the second diameter d2. FIGS. 5A and 5B show another embodiment of the coupling portion 150 with a coupling joint 158' comprising an outer surface 155 defining a plurality of recesses 157 and further defining an outlet 160. The plurality of recesses 157 may be configured to decrease friction between the coupling joint 158' and the dip tube 170 to improve the ease at which the dip tube 170 may be adjusted while coupled to the coupling portion 150 or coupling joint 158'. The coupling portion channel 154' may have a first diameter d1' proximate the valve chamber 151 and a second diameter d2' proximate the dip tube 170. As shown, the first diameter d1' is greater than the second diameter d2', however in other embodiments the first diameter d1' may be less than or equal to the second diameter d2'.

Figure 6:
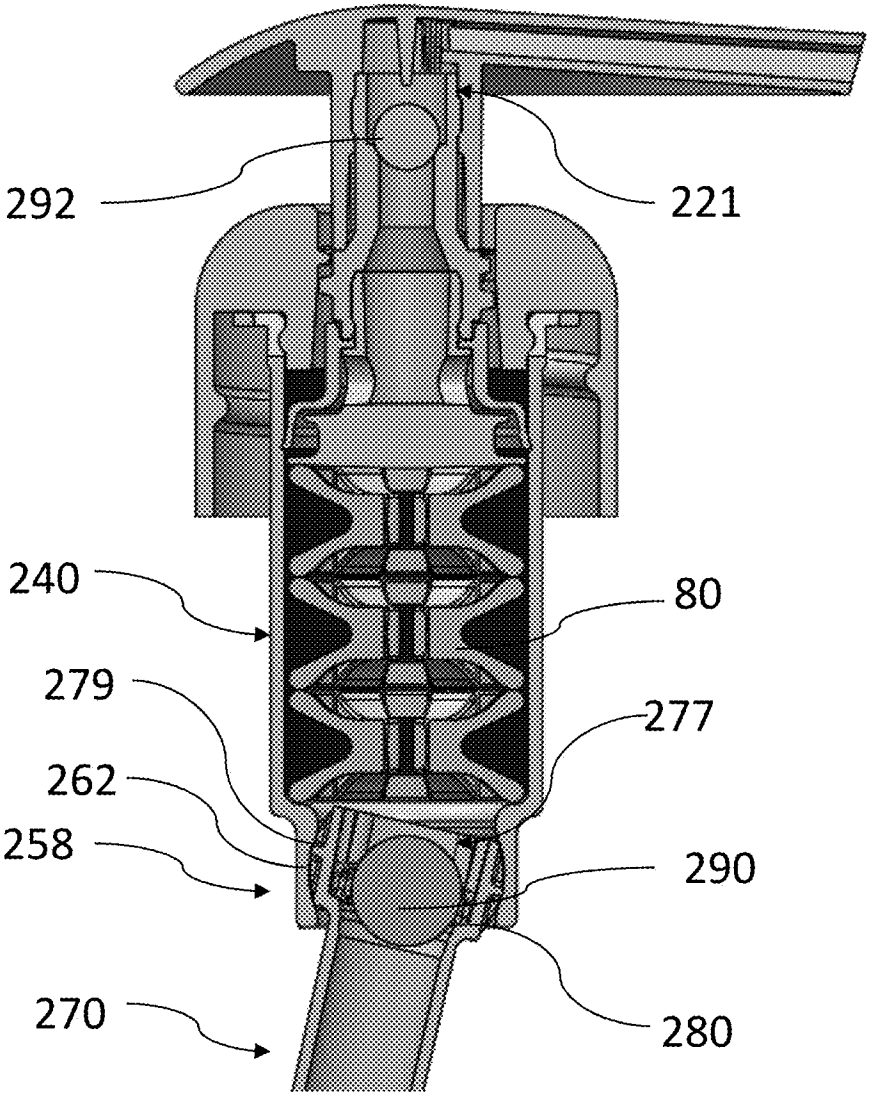
FIG. 6 illustrates a cross-sectional view of another embodiment of the pump assembly.

An alternate embodiment of the pump assembly 200 is shown in FIG. 6. In this embodiment, the dip tube 270 may comprise a coupling joint 280 that is configured to engage an end of the coupling portion 250. As shown, the coupling portion 250 includes a coupling joint receptor 262 that engages and mates with the coupling joint 280 of the dip tube 270. In an embodiment, the coupling joint receptor 262 may be configured to deform elastically or plastically in order to engage or at least partially fit around the coupling joint 280 in order to create a friction fit between the coupling joint receptor 262 and the coupling joint 280 that is water-tight. In the embodiment shown, the ball valve 290 may be positioned within a valve chamber 277 positioned within the dip tube 270. In an embodiment, the coupling joint 180 may have one or more recesses or protrusions 279 configured to aid in coupling the coupling joint 180 to the coupling portion 250 and/or the coupling joint receptor 262 and may improve the ease at which the dip tube 270 can be pivoted with respect to the coupling portion 250 or coupling joint 258. As with previously discussed embodiment, the sleeve 240 and the dip tune 270 remain fluidly connected as the dip tune 270 is pivoted relative to the sleeve 240.

Turning now to FIG. 7, a schematic depiction of the dispenser container 100 from FIG. 2 is being used with the prior art pump assembly 10 and dip tube 70 from FIG. 1. The pump assembly 10 has been omitted from the figure, however one can see that the dip tube 70 extends into the dispenser container 100 and is held a distance from the bottom surface 104 in order to avoid obstructing the open end 78 of the dip tube 70. Here, the dip tube 70 is generally positioned in the center of the of the inner space 116 of the dispenser container 100 (i.e., about equidistant from the sides 114). Accordingly, the open end 78 of the dip tube 70 is generally positioned above the apex 106 of the bottom surface 104. Consequently, when the level S of the contents 108 in the dispenser container 100 nears the apex 106, the open end 78 of the dip tube 70 is exposed and the pump assembly 10 is unable to extract the remaining contents 108 from the dispenser container 100. The remaining contents 108 further collects in the annular depression 105 or annular valley and is discarded along with the dispenser container 100 and pump assembly 10.

Figure 8:
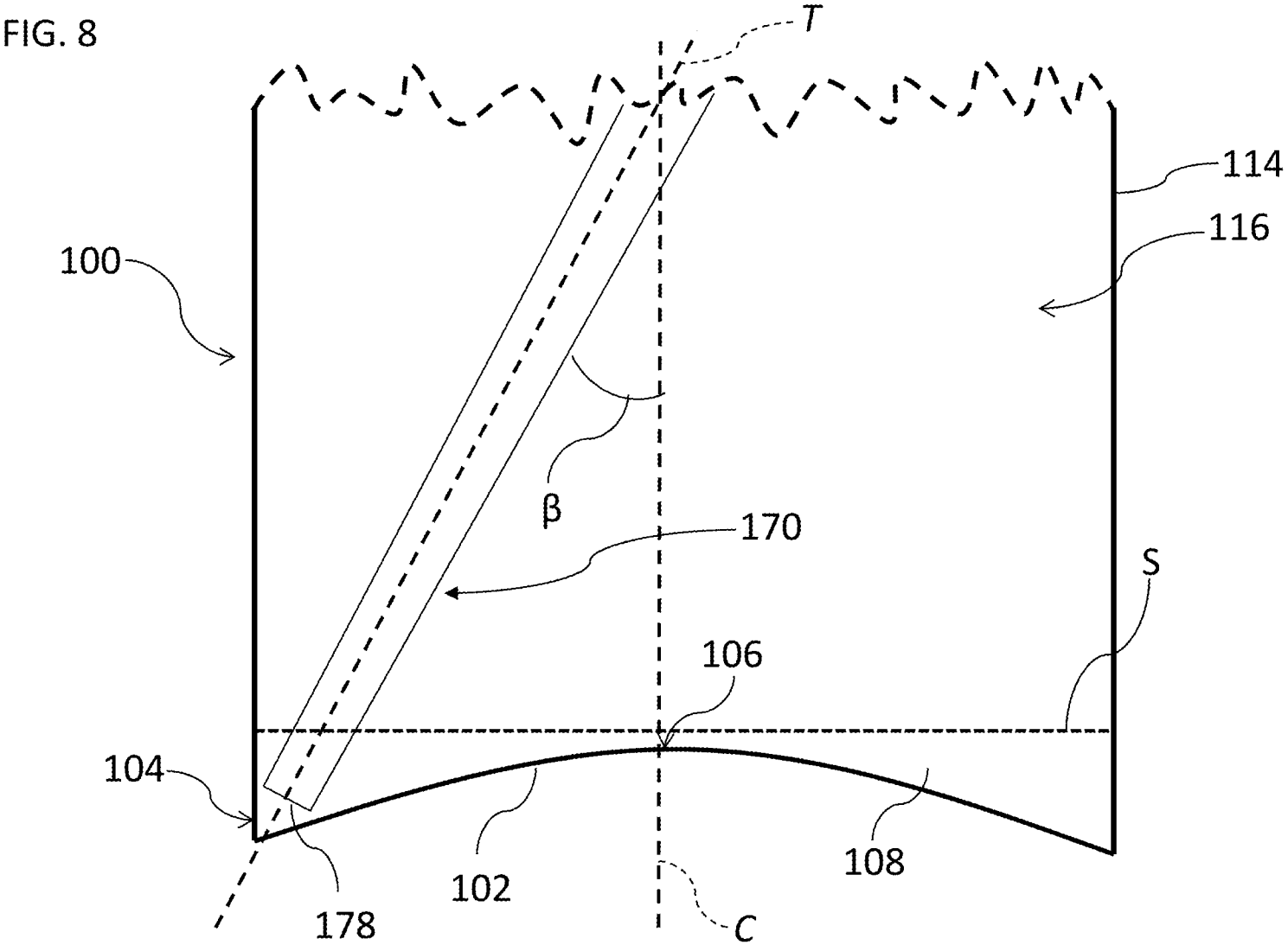
FIG. 8 illustrates a schematic depiction of the pump assembly showing the position of the dip tube dip of FIGS. 3, 4, and 6, when the pump assembly is installed onto a dispensing container.

In contrast, FIG. 8 shows the schematic depiction of the dispenser container 100 from FIG. 2 being used with the pump assembly 100 of FIG. 4B comprising the sleeve 140 and dip tube 170 as shown in FIGS. 3, 4, and 6. Like in FIG. 7, the pump assembly 100 has been omitted from the figure, but one can see that the dip tube 170 extends into the dispenser container 100 and is held a distance from the bottom surface 104 in order to avoid obstructing the open end 178 of the dip tube 170. Here, the dip tube 170 extends along the dip tube axis T, which is positioned at an angle β (or intersects at an angle β) relative to the container axis C. The angle β may be greater than 0', but not more than 30°. Accordingly, the open end 178 of the dip tube 170 is generally positioned in the valley or annular reservoir 105, below the level of the apex 106 of the bottom surface 104. When the level S of the contents 108 in the dispenser container 100 nears the apex 106, the open end 178 of the dip tube 170 remains submerged and the pump assembly 100 is able to continue extracting the contents 108 of the dispenser container 100 even as the level falls below the apex 106. As a result, more of the contents 108 is made available to the consumer and there is less waste.

As shown in the embodiments of FIGS. 3-6, and 8, the ability of the dip tube 170, 270 to swivel, rotate, and pivot (articulate) about the coupling joint 158, 258 enables the user and/or the manufacturer to adjust the position of the dip tube 170, 270 to accommodate dispenser containers 100 of varying configurations. This means that the same pump assembly 100, 200 with sleeve 140, 240 and dip tube 170, 270 may be used for a variety of different dispensing containers with varying shapes and bottom surfaces, which reduces manufacturing costs and ultimately the final price of the product. Moreover, the friction fit of the dip tube with the coupling portion or sleeve prevents movement of the dip tube when the pump assembly 100, 200 is used in a high-speed automated assembly system. Consequently, no additional stabilizing components are required to maintain the position of the dip tube prior to or during installation onto the dispensing container 100.

One or more of the components of the pump assembly 100, 200 including the sleeve 140, 240 and the dip tube 170, 270 may be manufactured using injection molding methods. The components of the pump assembly 100, 200 including the sleeve 140, 240 and the dip tube 170, 270 are manufactured from the same type of recyclable material, for example polyolefin. The same "type" of recyclable material refers to material that is classified under the same recycling code or otherwise classified such that further processing to separate out components of the pump assembly 100, 200 is not required during the recycling process. The pump assembly 100, 200 as described herein is made of the same type of recyclable material such that it may be recycled while in the assembled state indicated in FIG. 8.

Additional embodiments include any one of the embodiments described above and described in any and all exhibits and other materials submitted herewith, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claim which follows, they are used only in a generic and descriptive sense, and not for the purposes of limiting the present disclosure, nor the claims which follow.

The invention claimed is:

1. A pump assembly for a pump dispenser, the pump assembly comprising:

a cap comprising a depression surface and a spout extending from the depression surface;

a collar configured to at least partially surround the cap, wherein the depression surface is configured to move relative to the collar;

a sleeve coupled to the collar and comprising, a body extending along a body axis and defining an inner space, and a coupling member defining a coupling member channel, wherein the coupling member comprises, a shoulder, a coupling joint positioned adjacent to the shoulder; and a dip tube defining a dip tube channel extending from a first end to an opposing second end, wherein the first end of the dip tube is configured to pivotally couple to a portion of the coupling joint and fluidly connect the dip tube channel, the coupling member channel, the inner space of the sleeve, and the spout, and wherein the fluid connection is maintained when the dip tube is pivoted relative to the portion of the coupling joint.

2. The pump assembly of claim 1, wherein the dip tube channel comprises a first diameter at the first end and second diameter at the second end that is different than the first diameter.

3. The pump assembly of claim 1, further comprising a valve positioned in a valve chamber defined within the coupling member.

4. The pump assembly of claim 1, further comprising a valve positioned in a valve chamber defined within the dip tube.

5. The pump assembly of claim 1, wherein the first end of the dip tube comprises a greater thickness than the second end.

6. The pump assembly of claim 3, wherein the first end of the dip tube is configured to at least partially fit over the coupling member.

7. The pump assembly of claim 4, wherein the first end of the dip tube is configured to be at least partially positioned within the coupling member.

8. The pump assembly of claim 1, wherein the portion of the coupling joint comprises an outer surface defining one or more recesses configured to decrease friction between the portion of the coupling joint and the dip tube when the dip tube is pivoted relative to the portion of the coupling joint.

9. The pump assembly of claim 1, wherein the shoulder is configured to inhibit damage to the first end of the dip tube resulting from over-insertion of the first end onto the coupling joint.

10. A pump assembly for a pump dispenser, the pump assembly comprising:

a cap comprising a spout;

a sleeve in fluid communication with the cap and comprising, a body extending along a body axis and defining an inner space, and a coupling member connected to the body and defining a coupling member channel; and a dip tube defining a dip tube channel extending from a first end to an opposing second end, wherein the first end of the dip tube is configured to pivotally couple to a portion of the coupling member and move relative to the portion of the coupling member, wherein a fluid connection to the dip tube channel, the coupling member channel, the inner space of the sleeve, and the spout is established and maintained when the dip tube is pivoted relative to the portion of the coupling member.

11. The pump assembly of claim 10, wherein the dip tube channel comprises a first diameter at the first end and second diameter at the second end that is different than the first diameter.

12. The pump assembly of claim 10, further comprising a valve positioned in a valve chamber defined within the coupling member.

13. The pump assembly of claim 10, further comprising a valve positioned in a valve chamber defined within the dip tube.

14. The pump assembly of claim 10, wherein the first end of the dip tube comprises a greater thickness than the second end.

15. The pump assembly of claim 12, wherein the first end of the dip tube is configured to at least partially fit over the coupling member.

16. The pump assembly of claim 13, wherein the first end of the dip tube is configured to be at least partially positioned within the coupling member.

17. A pump assembly for a pump dispenser, the pump assembly comprising:

a spout;

a sleeve in fluid communication with the spout and comprising, a body extending along a body axis and defining an inner space, and a coupling member defining a coupling member channel; and a dip tube defining a dip tube channel extending from a first end to an opposing second end, wherein the first end of the dip tube is configured to pivotally couple to a portion of the coupling member and move relative to the portion of the coupling member, wherein a fluid connection to the dip tube channel, the coupling member channel, the inner space of the sleeve, and the spout is established and is maintained when the dip tube is pivoted relative to the portion of the coupling member.

18. The pump assembly of claim 17, wherein the dip tube channel comprises a first diameter at the first end and second diameter at the second end that is different than the first diameter.

19. The pump assembly of claim 17, further comprising a valve positioned in a valve chamber defined within the coupling member.

20. The pump assembly of claim 17, further comprising a valve positioned in a valve chamber defined within the dip tube.

* * * * *